US007143707B2

(12) United States Patent
Becker

(10) Patent No.: US 7,143,707 B2
(45) Date of Patent: Dec. 5, 2006

(54) WATER JET DRIVE FOR MARINE VEHICLES

(76) Inventor: Karl-Josef Becker, Im Vogelsang 31b, 56321 Rhens (DE)

( * ) Notice: Subject to any disclaimer, the term of this patent is extended or adjusted under 35 U.S.C. 154(b) by 0 days.

(21) Appl. No.: 10/530,008

(22) PCT Filed: Oct. 4, 2002

(86) PCT No.: PCT/EP02/11114

§ 371 (c)(1),
(2), (4) Date: Mar. 30, 2005

(87) PCT Pub. No.: WO2004/033289

PCT Pub. Date: Apr. 22, 2004

(65) Prior Publication Data

US 2006/0003643 A1 Jan. 5, 2006

(51) Int. Cl.
*B63H 25/46* (2006.01)

(52) U.S. Cl. ..... 114/151; 440/38

(58) Field of Classification Search ..... 114/151; 440/38

See application file for complete search history.

(56) References Cited

U.S. PATENT DOCUMENTS

| | | | | |
|---|---|---|---|---|
| 3,237,585 A | | 3/1966 | Winter | |
| 3,263,643 A | * | 8/1966 | Tattersall | 440/38 |
| 5,484,266 A | | 1/1996 | Murga | |
| 5,520,558 A | | 5/1996 | Kobayashi | |
| 5,536,187 A | | 7/1996 | Nanami | |
| 6,027,383 A | | 2/2000 | Broinowski | |

FOREIGN PATENT DOCUMENTS

| | | |
|---|---|---|
| CH | 551 311 | 7/1974 |
| EP | 0 024 443 | 3/1981 |
| GB | 866 033 | 4/1961 |

OTHER PUBLICATIONS

Davison et al., Multistage Waterjets, 11th International Symposium on Yacht Design and Yacht Construction, held on Nov. 13-14, 1990, in Amsterdam.

* cited by examiner

*Primary Examiner*—Ed Swinehart
(74) *Attorney, Agent, or Firm*—McGlew & Tuttle, PC

(57) ABSTRACT

A compact operational retro-fit drive plant, for installation in the base of the bow or stern of various types of marine vehicle, in particular of displacement types, which serves for maneuvering and traveling at cruising speed on normal and particularly flat stretches of water. The drive plant includes a simple and economically produced water jet drive (1), having a propeller pump (8), for various types of engine and installations, which generates an efficient and completely controllable propeller thrust with optimized propeller approach flow and flat water capability. The propeller shaft (11) of the water jet drive (1) is arranged on the pressure side of the propeller pump (8) in a conventional 90 DEG elbow tube (6), the rotational axis (9) of the propeller is neither vertical nor horizontal, but has an inclination angle alpha of 20 DEG to 50 DEG, preferably between 25 DEG and 40 DEG relative to the baseplate (20) as a horizontal base. At the other end (14) of the elbow tube (6), which points downwards at an angle, an outlet housing section (7) is connected thereto and provided with a rotating base deflector array (16), in order to have control in all directions over the exit jet and thus the propeller thrust under the base of the water jet drive (1).

18 Claims, 4 Drawing Sheets

WATER JET DRIVE FOR MARINE VEHICLES

CROSS REFERENCE TO RELATED APPLICATIONS

This application is a United States National Phase application of International Application PCT/EP2002/011114 of Oct. 4, 2002, the entire contents of which is incorporated herein by reference.

FIELD OF THE INVENTION

The present invention pertains to a hydrojet for watercraft.

BACKGROUND OF THE INVENTION

Hydrojets, which are preferably arranged on the bow side in the bottom area, have proved to be successful for improving maneuverability especially in watercraft used in shallow waters (e.g., in inland waters with varying water levels). Such hydrojets, also called bow jet units, comprise a housing, which can be installed in the bottom of the particular watercraft and which contains at least one propeller (or a pump impeller), which introduces energy into the water fed in via a bottom-side housing intake and releases the water, for example, via an elbow and channels in their direction, or steers it all round through at least one discharge opening, which is flush with the bottom and can usually be pivoted by 360° under the bottom of the boat.

The axis of rotation of the propeller or of the pump impeller extends either in the horizontal direction or in the vertical direction in prior-art hydrojets.

In case of vertical arrangement of the propeller, i.e., rotation around a horizontal transverse axis in a cross jet tunnel, it shall be borne in mind that the water line should be about half the propeller diameter above the vertex of the tunnel to avoid the inrush of air and the drop in thrust caused thereby. This leads to the drawback that the watercraft in question has a relatively great draft and requires a corresponding depth of the shipping channel in order to be able to manoeuver without risk and efficiently.

Besides this, hydrojets with vertical arrangement of the propeller are also known, which have a bottom intake according to the principle of usual axial jets in order to reduce the draft. Because the suction behavior of axial-flow pumps allows a limited emersion of the propeller blades only, a draft ratio that depends on the function is to be ensured.

A hydrojet for the bow control of a watercraft with horizontally aligned propeller axis of rotation is known from EP 0 024 443 A. In this prior-art hydrojet, the discharge opening for the water jet is located in the direction of travel in front of the intake opening, such that only a brake thrust and a maneuvering thrust for the support of the helm on the stern side can be produced. In contrast, an efficient driving thrust cannot be produced with a hydrojet designed in this way and arranged in the ship's bow, because a propulsion of the thrust jet, generating and in this respect with a relatively flat slope in the forward direction crosses or strongly swirls the suction flow directed sharply upwards there. The turbulences and suction effects produced thereby increase the intake losses sharply and thus drastically reduce the thrust development in this control zone. The propeller water drawn in in this case likewise contributes to thrust reduction, because it is accelerated less with higher intake velocity and thus produces less thrust.

Even though hydrojets with vertically directed axis of rotation require a relatively small draft for air-free operation for the propeller (or pump impeller) arranged horizontally above a bottom intake, they do have, among other things, the drawback that in case of shallow depth of water (i.e., at less than, e.g., 50 cm of water under the keel), such drives generate a strong wake due to the suction effect directed directly toward the bottom, which wake increases the resistance of the boat and compromises the development of thrust or lets it collapse altogether when increased amounts of foreign bodies sucked in clog the protective grid, which is usually present. Furthermore, the risk for damage increases, because small foreign bodies can pass through the protective grid like a sieve and can increasingly enter between the blades.

In addition, it was found that in case of hydrojets with vertically directed axis of rotation of the propeller, the flow to be deflected into the vertical suction area begins to be broken down beginning from a certain velocity of travel with increasing speed, which will then lead to a drastic drop in thrust.

For driving via a horizontally arranged motor, hydrojets with vertical axis of rotation of the propeller require an angular gear of their own. For driving by means of internal combustion engines, a marine reversing gear, which as a second gear increases the mechanical losses and the cost of the unit, is also necessary for coupling and changing over the direction of rotation (for example, for flushing the protective grid).

Finally, a hydrojet for the bow control of boats has become known from CH 551 311 A, in which a propeller is provided, whose axis has a slope angle $\leqq 45°$ in relation to a horizontal base. As in the case of the above-mentioned EP 0 024 443 A, the discharge opening for the hydrojet in the direction of travel is located in front of the intake opening. The self-closing blades arranged there behind the propeller as well as the rudder action which is only efficient in the jet direction rule out a use of this jet for thrust production.

SUMMARY OF THE INVENTION

The basic object of the present invention is to propose a hydrojet that is as simple as possible and can be manufactured at a low cost, with an axial-flow pump, for watercraft, especially for displacement-type watercraft, which generates an efficient thrust with optimized incoming flow during maneuvering and with increasing speed and has better shallow water properties than the prior-art bow jet plants and can be welded (or laminated) into the bottom of a watercraft as a compact drive unit.

According to the invention, a hydrojet for watercraft is provided comprising a housing unit, which can be installed in the bottom of the watercraft and contains at least one propeller that can be rotated about a propeller axis and which delivers the water entering through a bottom-side intake opening of the housing unit through a bend and through a bottom deflecting grid arranged rotatably in a discharge opening of the housing unit. The discharge opening is flush with the bottom, and thus releases it under the housing unit. The propeller forms a pump, which is in functional connection with a drive arranged outside the housing unit, at least with a pump housing section of the housing unit. The axis of rotation of the propeller has a slope angle $\alpha$ between 20° and 50° in relation to the bottom plate as a horizontal base.

The present invention is based essentially on the idea of arranging the propeller shaft of the hydrojet on the delivery side of the particular axial-flow pump in a commercially available 90° pipe bend such that the axis of rotation of the propeller is not vertical or horizontal but has a slope angle α of 20° to 50°, preferably between 25° and 40°, in relation to the bottom plate as the horizontal base, and a discharge housing section is attached at the other, obliquely downwardly pointing end of the pipe bend and is provided with a rotatable bottom deflection grid in order to steer the discharge jet and hence the propeller thrust all round in all directions under the bottom of the hydrojet. On the other hand, the hydrojet is designed such that an intake housing section is provided, which is aligned with the main direction of travel in case of use of the hydrojet as authorized, whereby the bottom-side intake opening of the housing unit is arranged in front of the discharge opening.

Major advantages are achieved due to this measure concerning design and manufacture, the guiding of the flow and the development of the thrust, the speed and the draft, the installation of alternative drive motors, and the possibilities of installation in the watercraft models.

Due to the propeller being inclined toward the primary direction of the incoming flow and the conical pump intake nozzle, which avoids accumulations of air, which are harmful in the upper suction area (as opposed to round intake nozzles), the suction behavior is favorably affected with partially emerging propeller blades. Compared to hydrojets with horizontal axis of rotation of the propeller, the actual draft is markedly smaller than the necessary draft.

Due to the suction effect of the relatively flatly sloped propeller not being directed directly toward the bottom and the intake opening being larger (in relation to the propeller diameters of other hydrojets), the shallow water properties and the development of thrust, the wake effect, and the resistance are improved.

To achieve an especially compact design of the hydrojet according to the present invention, it proved to be advantageous for the hydrojet to comprise a housing unit, which can be inserted into the bottom of the boat and is formed from at least four housing sections, which are connected with one another: An intake housing section, which is flush with the bottom, is preferably designed for displacement-type watercraft and is joined concentrically by a tubular pump housing section with an axis sloped in relation to the horizontal. At an equal slope, a bent housing section, which is used as a housing base with an integrated propeller shaft mount and is preferably formed by a commercially available 90° semicircular bend, but may also have another shape, is attached at the other end of this pump housing section. A discharge housing section, in which a mount of a steerable bottom deflection grid is located, is attached at the other, obliquely downwardly pointing end of the bend.

To ensure optimal incoming flow at the propeller as a requirement for the efficient development of thrust for maneuvering during standing and at low speed, but also for speeding up to the cruising speed, the intake housing section is designed according to special shape and cross section features, which are best for the different incoming flow conditions (as they are similarly distinguished in suction and feed operation in stationary pumps).

Beginning flatly, the intake housing contour above the intake opening assumes a trapezoidal cross section with rounded corners until the radii of the corners form an arched cross section with a circular radius, in the course of the further rise, which is joined by a conical pump intake nozzle.

Due to the contours of this intake housing section being directed toward the principal direction of travel (i.e., forward travel) and as lateral and oblique incoming flows are also captured in a funnel-like manner, the water is fed optimally to the propeller, which is sloped toward the flow.

The tubular pump housing section, which is arranged between the intake housing section and the pipe bend and is made of an especially corrosion-resistant and wear-resistant material, forms as the central pump housing an axial-flow pump with at least one propeller and stator blades, which are arranged stationarily after it and convert the swirl energy into kinetic energy and act at the same time as webs for supporting the central bearing hub. An alternative supporting of the bearing hub, e.g., with spokes of a round cross section, etc., is likewise conceivable and included.

Depending on the conditions of the watercraft and the drive power needed, mainly electric motors and internal combustion engines, but also hydraulic motors are used for the drive. When electric motors are used, different drive speeds are preset depending on the onboard frequency (e.g., 50 Hz or 60 Hz) and the model of the motor (number of pole pairs). Therefore, it proved to be advantageous if the electric motor can either be attached directly by means of a coaxial housing bell or axially in parallel and by means of a high-output belt drive and a correspondingly selectable gear reduction above the hydrojet or even on the right-hand side or the left-hand side at the housing unit.

When the hydrojet is to be driven by means of an internal combustion engine, it proved to be particularly advantageous to connect the internal combustion engine with the propeller shaft via a marine gear of the so-called V version with a standard shaft slope angle of, e.g., 10°. As a result, an especially compact installation of the internal combustion engine at the hydrojet is possible. The engine and the gear can be preferably aligned with one another on a common base frame and arranged in a fixed manner, and the base frame is then mounted as an elastically mounted unit on the brackets arranged at the hydrojet. Besides the standard gear reduction variants for adjusting the speed of rotation, the reversing stage of this marine gear can be used to clean the intake protective grid by flushing.

To reach an efficient thrust in case of the predominant use in shallow waters, the intake housing section can be designed in special variants specific for the installation. By making, for example, the intake level of the front intake edge or of a lateral intake edge somewhat higher and/or by varying the slope of the front housing surface or of a lateral housing surface, flat, open areas can be created in the bow area or on the side of a watercraft, so that additional (air-free) water can flow to the propeller directly from the front or from the side (among other things, for example, in pontoon and double-ended ferries with lateral or diagonal jet installation).

The hydrojet according to the present invention can also be used for various types of watercraft and for various purposes, e.g., as a maneuvering and auxiliary unit and/or as a main drive unit in different positions in the bottom of the watercraft. Mainly watercraft for inland waters, such as freighters, passenger boats and utility boats as well as ferries, landing boats, watercraft used by authorities, and those in which increased requirements are imposed on holding positions, e.g., fire boats, diver boats, surveying and laboratory boats, etc., may be considered. However, the hydrojet according to the present invention may also be used, if designed correspondingly, as a maneuvering unit in coastal and ocean-going vessels.

Further details and advantages of the present invention will appear from the following exemplary embodiments explained on the basis of figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
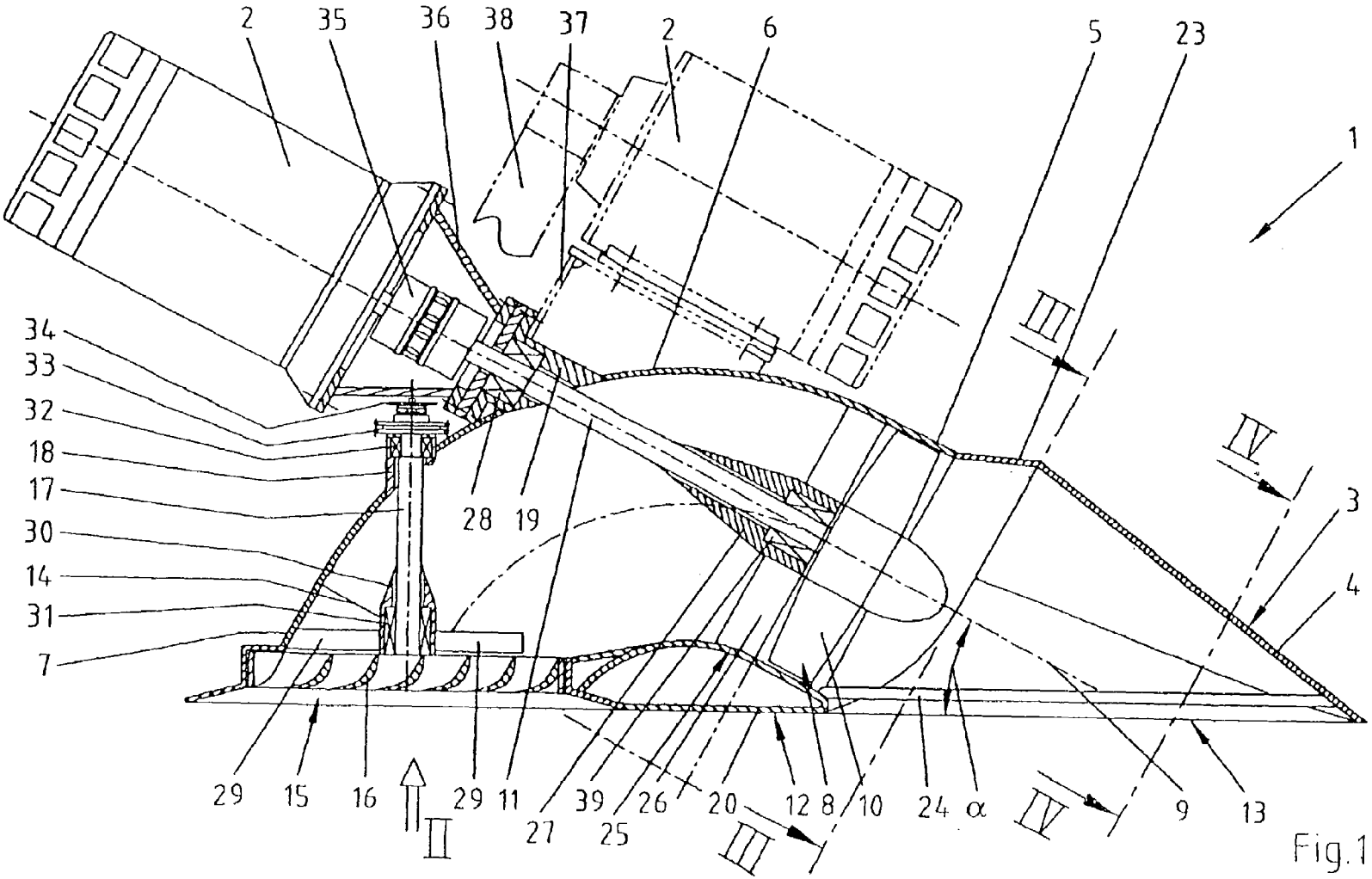
FIG. 1 is a longitudinal sectional view through a hydrojet according to the present invention with an electric motor as a coaxial direct drive or in axially parallel arrangement with a belt drive.
Figure 2:
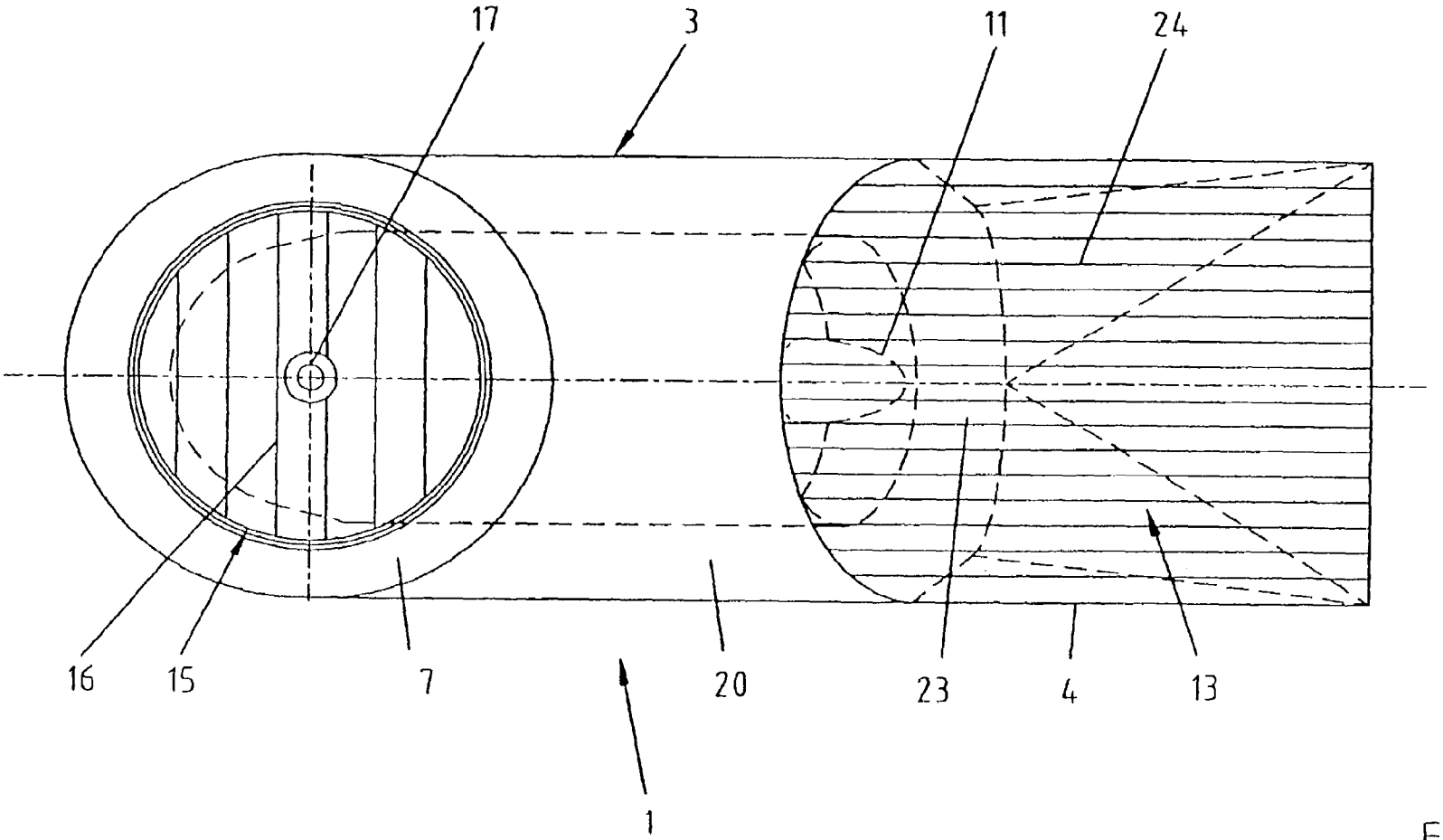
FIG. 2 is a bottom view of the hydrojet shown in FIG. 1 from the direction designated by II in FIG. 1.

Referring to the drawings in particular, a hydrojet according to the present invention, which can be driven either by means of a coaxially attached electric motor 2 (flange motor) or by means of an electric motor 2' (conventional motor) attached axially in parallel via a belt drive 33 and a corresponding gear reduction with the desired propeller speed or circumferential velocity, is designated by 1 in FIG. 1.

The hydrojet 1 comprises a housing unit 3, which can be inserted into the bottom of the boat (not shown) and comprises four housing sections 4–7: An intake housing section 4, which is preferably designed for displacement-type watercraft, is flush with the bottom and is joined concentrically by a tubular pump housing section 5 for accommodating a propeller 10. According to the present invention, the axis of rotation 9 of the propeller and hence also the propeller shaft 11 are arranged at a slope angle $\alpha$ of preferably 28° in relation to a horizontal base, which is formed by the bottom plate 20 of the housing unit 3.

A pipe bend 6, which is used to mount the propeller shaft 11 as a housing base and may be a commercially available 90° semicircular bend, is attached to the pump housing section 5 in the direction of the sloped axis of rotation 9 of the propeller. A discharge housing section 7, which is flush with the bottom, is attached with a discharge opening 15 at the other, obliquely downwardly pointing end of the bend 14 of the pipe bend 6, a pivotable bottom deflecting grid 16 for steering the water jet being arranged in the discharge opening 15.

To pass through, mount and seal the steering shaft 17 and the propeller shaft 11, support studs 18, 19, which are concentric with the respective shaft axes, are arranged on the semicircular bend 6.

The water-carrying housing sections 4–7 and a bottom plate 20 connecting the intake and discharge openings 13 and 15 are connected with one another by a prefabricated housing unit 3, which can be completed with corresponding motor brackets 37 and anchor brackets 45, 46 for the installation of the desired drive motor 2, 2' or 40.

Furthermore, the housing unit 3 may be made with an inspection cover above the lowest-draft water line (not shown), which makes possible the inspection and cleaning of the intake area from the engine room.

Due to the contours of the intake housing section 4 being directed in the principal direction of travel (i.e., forward travel), the water is fed optimally to the propeller 10, which is sloped toward the flow. Oblique and lateral incoming flows are also captured by means of the lateral surfaces of the intake housing section 4, which are extended obliquely outwardly according to FIGS. 3 and 4.

Figure 3:
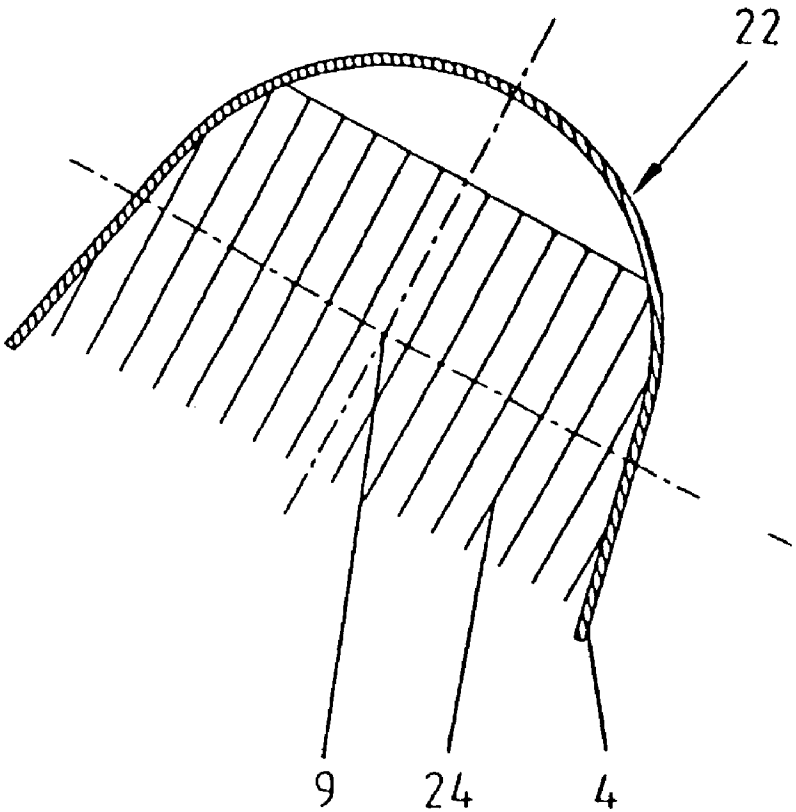
FIGS. 3 is a sectional view along the section line designated by III—III in FIG. 2.
Figure 4:
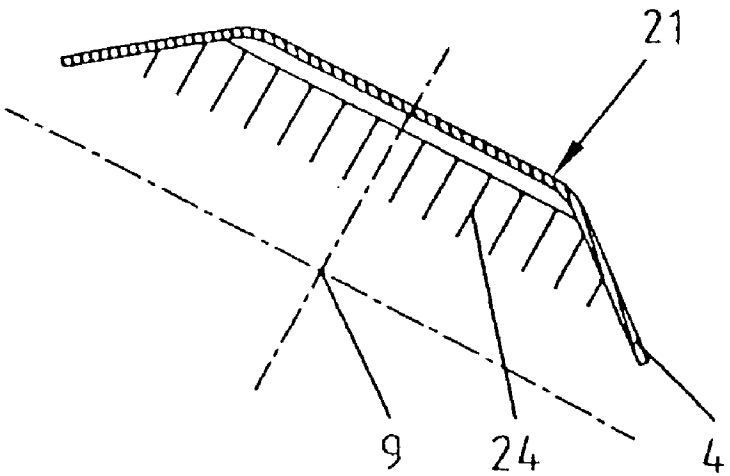
FIG. 4 is a sectional view along the section line designated by IV—IV in FIG. 2.

The contours of the intake housing section 4 are selected here to be such that the sections of the tunnel cross sections 21, 22 in FIGS. 3 and 4 increase continuously in terms of their height and their upper corner radii until they form a tunnel with a circular arch, to which a conical pump intake nozzle 23 is added. The contour of the pump intake nozzle 23 decreases under the axis of rotation 9 of the propeller until it passes over into the bottom plate 20 in the downward direction. Alternative embodiments to this are conceivable and included.

A protective grid 24 against foreign bodies of a harmful size, which is either mounted permanently or is arranged pivotably to shake off foreign bodies that may be present and grants easy access to the intake area and the propeller 10 for inspection, maintenance and in case of repair, is located in the area of the intake opening 13 of the intake housing section 4.

The tubular pump housing section 5 arranged between the intake housing section 4 and the pipe bend 6 forms the pump housing with a narrow radial gap around at least one propeller 10 and the impeller pump 8 together with the guide vanes 26 arranged behind it, which convert the swirl energy into kinetic energy and at the same time support the bearing hub 27. An alternative hub support with, e.g., nonprofiled spokes (instead of 26) is conceivable and included. The propeller-like bearing hub 27 preferably contains a usual water-lubricated propeller shaft gliding surface bearing 39.

The upper propeller shaft bearing 28 sealed on both sides is provided as a grease-lubricated rolling bearing for absorbing axial and radial loads and is arranged in the support stud 19 attached on the pipe bend 6.

A bearing hub 30 supported via webs 29 is likewise arranged in the discharge housing section 7 for receiving and mounting the bottom deflection grid 16, at least two webs 29 being arranged above the front half of the bottom such that they facilitate the guiding of the flow to and through the bottom deflection grid 16 there.

For steering the bottom deflecting grid 16 all round, the vertical steering shaft 17 is preferably mounted in the support stud 18 of the housing unit 3, at the bottom in a water-lubricated gliding surface bearing 31 and at the top in a grease-lubricated rolling bearing 32, which is sealed on both sides and can absorb axial and radial loads. A driving hub 33 for the steering drive (not shown) and a small power take-off hub 34 for the optical and electric thrust direction display (not shown) are arranged on the steering shaft 17.

The electric motor 2 (flange motor) is connected with the propeller shaft 11 via an elastic shaft coupling 35 and is mounted on the support stud 19 of the housing unit 3 via a coaxial housing bell 36. The use of an electric motor 2' (conventional motor) and of a corresponding high-performance belt drive 38 to drive the propeller shaft 11 make it possible to adapt frequency-dependent motor speeds to a uniform propeller speed or to a certain circumferential velocity. Depending on the given space conditions, the electric motors 2, 2' can be installed optionally in front of the propeller shaft 11 or by means of an axially parallel motor bracket 37 above or also laterally at the housing unit 3 of the hydrojet 1 to form a ready-to-operate drive unit.

Figure 5:
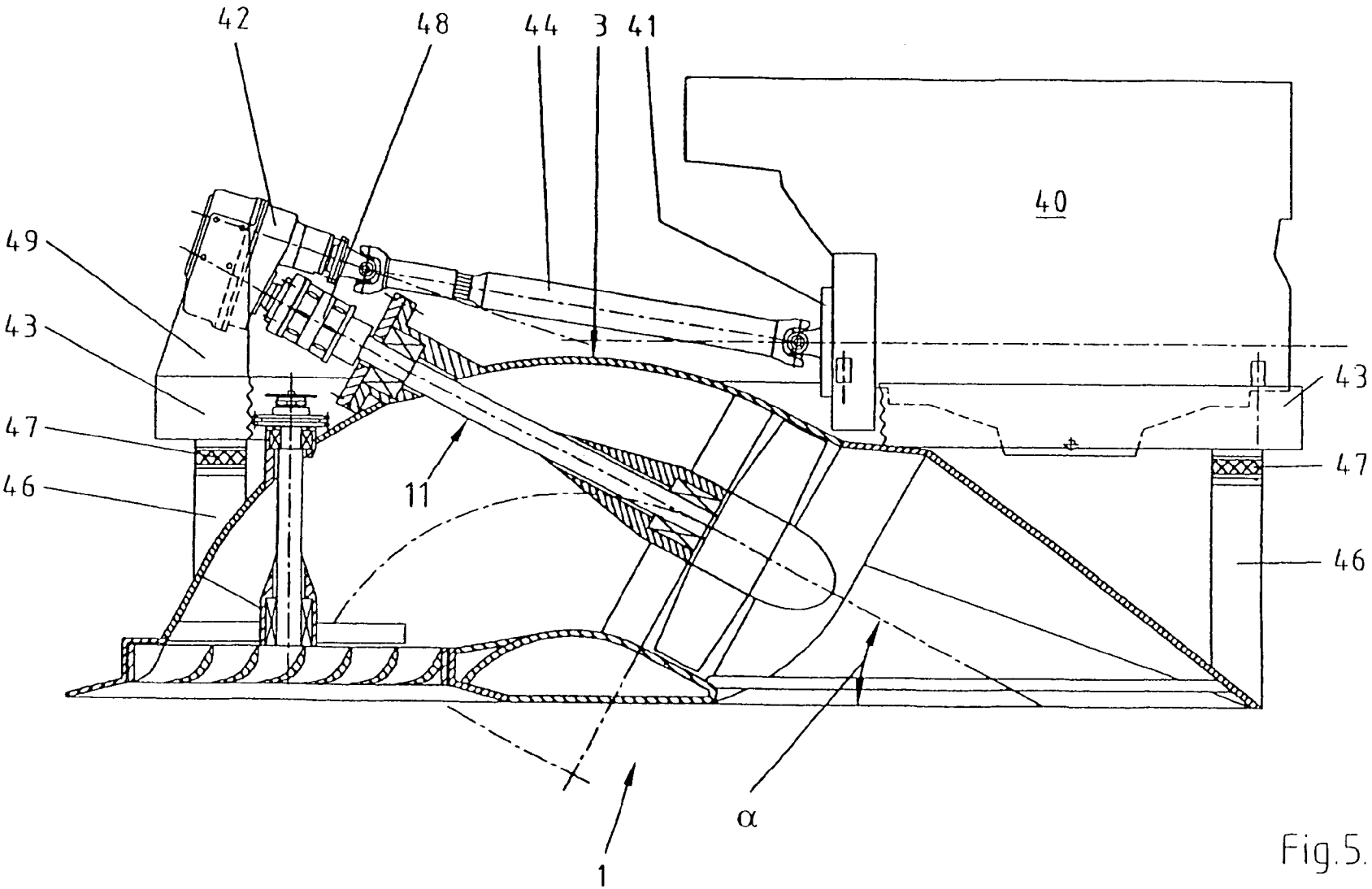
FIG. 5 is a cross sectional view of the hydrojet shown in FIG. 1 with an internal combustion engine as the drive.

An internal combustion engine 40 is provided for driving the hydrojet 1 in the exemplary embodiment of the present invention shown in FIG. 5. To achieve a compact and advantageous arrangement of the drive components, the internal combustion engine 40 is mounted with the rotationally elastic motor coupling 41 attached thereto, together with a commercially available marine gear 42, preferably of a V version (i.e., the horizontal drive axis and the sloped power take-off axis form a "horizontal V") on a common base frame 43 and positioned such that a W arrangement with two equal bending angles of a permissible size is obtained for the cardan shaft 44 to be connected.

The base frame 43 is aligned with the propeller shaft 11 on anchor brackets 45, 46, which are arranged at the housing unit 3, at least at four points via rubber-metal damping elements 47 and mounted elastically. Load-dependent displacements and spring incursions are compensated by the elastic shaft coupling 48 in a double cardanic design. Moreover, the rubber-metal damping elements 47 and the two elastic elements of the coupling 48 are used at the same time to effectively damp the transmission of vibrations and structure-borne noise to the hydrojet 1 and thus to the hull.

The present invention is, of course, not limited to the above-described exemplary embodiments. Thus, the hydrojet may, in principle, also be designed with a two-stage axial-flow pump (pump with a propeller shaft 11 and two propellers 10 with guide vanes 26 located between them) instead of with the one-stage axial-flow pump shown in FIGS. 1–5.

Besides, the hydrojet 1 may also be designed with a variable-pitch blade impeller pump, instead of with a fixed-pitch impeller pump, in which case the propeller shaft 11 is hollow in order to pass through, e.g., an actuating rod or lines for adjusting the propeller blades (the pitch of the respective propeller blades). In case of a drive by means of an electric motor installed with parallel axis, the means for adjusting the pitch can be mounted in front of the support stud 19 at the hydrojet 1. In case of an internal combustion engine as the drive motor, it is possible to pass, e.g., an extended actuating rod through the shaft coupling 48 and the hollow power take-off shaft of the marine gear 42, so that the adjusting means can be attached to the marine gear 42, as usual, on the outside.

While specific embodiments of the invention have been shown and described in detail to illustrate the application of the principles of the invention, it will be understood that the invention may be embodied otherwise without departing from such principles.

The invention claimed is:

1. A hydrojet for watercraft, the hydrojet comprising:

a) a housing unit, which can be installed in the bottom of the watercraft and contains at least one propeller that can be rotated about a propeller axis and delivers the water entering through a bottom-side intake opening and through said housing section of the housing unit through a bend and through a bottom deflecting grid arranged rotatably, by means of a steering shaft, in a discharge opening of the housing unit, which said discharge opening is flush with the bottom, and thus releases it under the housing unit;

b) the propeller forms an axial flow pump, which is in functional connection with a drive, at least with a propeller shaft arranged on a delivery side of the bend in a space between said discharge opening and said propeller and a pump housing section of the housing unit;

c) the axis of rotation of the propeller sloping towards the primary flow direction, which axis of rotation extends at an angle down to the intake opening of the housing unit, has a slope angle ($\alpha$) between 20° and 50° in relation to a bottom plate as a horizontal base; and d) the hydrojet being designed such that the intake housing section is aligned with the main direction of travel in case of the normal use of the hydrojet, and the bottom-side intake opening of the housing unit is arranged in front of the discharge opening.

2. A hydrojet in accordance with claim 1, wherein the axis of rotation of the propeller has a slope angle ($\alpha$) between 25° and 40° in relation to the bottom plate as a horizontal base.

3. A hydrojet in accordance with claim 1, wherein the housing unit of the hydrojet comprises at least four housing sections connected with one another and including: an intake housing section, through which the water enters the pump, a tubular pump housing section comprising the propeller, a bent housing section for deflecting the flow of water, and a discharge housing section provided with a pivotable bottom deflecting grid.

4. A hydrojet in accordance with claim 3, wherein above the intake opening, the contour of the intake housing section forms a trapezoidal tunnel cross section, which forms a, circularly arched tunnel cross section in the course of the further rise and then passes over, via a conical pump intake nozzle, into a circular cross section, which opens concentrically into the pump housing section of the housing unit.

5. A hydrojet in accordance with claim 3, wherein the bent housing section is a 90° pipe bend.

6. A hydrojet in accordance with claim 1, wherein the drive of the pump is an electric motor, which is fastened to the housing unit either on the front side or axially in parallel to a propeller shaft.

7. A hydrojet in accordance with claim 1, wherein the drive of the pump is an internal combustion engine, which is fastened to the housing unit, wherein the drive and a propeller shaft are connected at least via a gear, which has a power input and power output on the same side.

8. A hydrojet in accordance with claim 3, wherein a protective grid is arranged in the intake housing section of the housing unit.

9. A hydrojet in accordance with claim 1, wherein the propeller of the pump is a variable-pitch propeller.

10. A hydrojet for a watercraft, the hydrojet comprising:

a housing unit adapted for installation in a bottom of the watercraft, said housing unit having a bottom plate as a base, a bottom-side intake opening arranged in a normal direction of travel, a bend and a discharge opening, said discharge opening being substantially flush with the bottom of the watercraft with said intake opening arranged in front of said discharge opening with respect to the normal direction of travel;

a steering shaft with connected bottom deflecting grid arranged pivotably in said discharge opening;

a drive arranged outside said housing unit, the drive driving a propeller shaft arranged on a delivery side between said discharge opening and said propeller in the bend;

a propeller mounted in said housing unit for rotation about a propeller axis of rotation for delivering water entering through said bottom-side intake opening of the housing unit through said bend and through said bottom deflecting grid to releases the water under the housing unit, said propeller defining a pump with a pump housing section of said housing unit, said propeller being in functional connection with said drive, said propeller axis of rotation having a slope angle ($\alpha$) between 20° and 50° in relation to said bottom plate.

11. A hydrojet in accordance with claim 9, wherein said slope angle ($\alpha$) is between 25° and 40° in relation to said bottom plate.

12. A hydrojet in accordance with claim 11, wherein said housing unit comprises an intake housing section, through which the water enters the pump, a tubular pump housing section housing the propeller, a bent housing section for deflecting the flow of water, and a discharge housing section provided with said deflecting grid.

13. A hydrojet in accordance with claim 12, wherein above the intake opening, a contour of said intake housing section forms a trapezoidal tunnel cross section, which forms a, circularly arched tunnel cross section in a course of a further rise and downstream passes over, via a conical pump intake nozzle, into a circular cross section, said circular cross section opening concentrically into the pump housing section of the housing unit.

14. A hydrojet in accordance with claim 13, wherein the bent housing section is a 90° pipe bend.

15. A hydrojet in accordance with claim 10, wherein said drive comprises an electric motor fastened to said housing unit either on the front side or axially in parallel to said propeller shaft.

16. A hydrojet in accordance with claim 10, further comprising a gear having a power input and power output on a same side; and a propeller shaft connected to said drive and to said propeller, wherein said drive comprises an internal combustion engine fastened to said housing unit, wherein said drive and said propeller shaft are connected at least via said gear.

17. A hydrojet in accordance with claim 10, further comprising a protective grid arranged in an intake housing section of said housing unit.

18. A hydrojet in accordance with claim 1, wherein said propeller is a variable-pitch propeller.

* * * * *